US011559708B2

(12) United States Patent
Zilberstein et al.

(10) Patent No.: US 11,559,708 B2
(45) Date of Patent: Jan. 24, 2023

(54) ELECTRONIC RESPIRATOR MASK

(71) Applicant: Valam Corporation, New York, NY (US)

(72) Inventors: Gleb Zilberstein, Rehovot (IL); Yosef Krespi, New York, NY (US); Ron Hadani, Herzliya (IL)

( * ) Notice: Subject to any disclaimer, the term of this patent is extended or adjusted under 35 U.S.C. 154(b) by 1073 days.

(21) Appl. No.: 15/141,288

(22) Filed: Apr. 28, 2016

(65) Prior Publication Data

US 2016/0317848 A1 Nov. 3, 2016

Related U.S. Application Data

(60) Provisional application No. 62/153,881, filed on Apr. 28, 2015.

(51) Int. Cl.

| | |
|---|---|
| ***A62B 23/02*** | (2006.01) |
| ***A62B 18/02*** | (2006.01) |
| ***B03C 3/70*** | (2006.01) |
| ***B03C 3/47*** | (2006.01) |

(52) U.S. Cl.

CPC ..... *A62B 23/02* (2013.01); *A62B 18/025* (2013.01); *B03C 3/47* (2013.01); *B03C 3/70* (2013.01)

(58) Field of Classification Search

CPC ..... A62B 23/02; A62B 18/025; B03C 3/40; B03C 3/47; B03C 3/70; A61M 16/0003; A61M 16/0051; A61M 16/0087; A61M 16/021; A61M 16/06; A61M 16/0605; A61M 16/0611; A61M 16/0616; A61M 16/0622; A61M 16/0627; A61M 16/0633; A61M 16/0638; A61M 16/0644; A61M 16/065; A61M 16/0655

USPC ..... 128/205.27

See application file for complete search history.

(56) References Cited

U.S. PATENT DOCUMENTS

| | | | | |
|---|---|---|---|---|
| 2,067,822 | A * | 1/1937 | Biederman | A62B 18/025 128/206.16 |
| 3,980,541 | A * | 9/1976 | Aine | B01D 17/06 204/554 |
| 2002/0190866 | A1* | 12/2002 | Richardson | A62B 7/00 340/632 |
| 2003/0164095 | A1* | 9/2003 | Joannou | B03C 3/09 96/59 |
| 2004/0216745 | A1* | 11/2004 | Yuen | A62B 19/00 128/205.27 |

(Continued)

*Primary Examiner* — Samchuan C Yao
*Assistant Examiner* — Nathan M Le
(74) *Attorney, Agent, or Firm* — Joseph P. Aiena

(57) ABSTRACT

An electronic respiratory mask capable of filtering air that passes through is disclosed herein. In an embodiment, a face mask includes a body having an inner volume that surrounds the user's mouth when the body is placed over the user's mouth, a first electrode located on the body, the first electrode sized and shaped to allow air to pass between the inner volume of the body and an outside environment when the body is placed over the user's mouth, and a second electrode located on the body, the second electrode sized and shaped to allow air to pass between the inner volume of the body and the outside environment when the body is placed over the user's mouth, wherein the first and second electrode create an electric field gradient that is capable of suspending microbes as air passes between the inner volume of the body and the outside environment.

18 Claims, 10 Drawing Sheets

(56) References Cited

U.S. PATENT DOCUMENTS

| | | | | |
|---|---|---|---|---|
| 2012/0174922 | A1* | 7/2012 | Virr | A61M 16/0066 128/203.12 |
| 2013/0104733 | A1* | 5/2013 | Bangera | A62B 23/025 95/8 |

* cited by examiner

ELECTRONIC RESPIRATOR MASK

PRIORITY CLAIM

The present application claims priority to U.S. Provisional Application No. 62/153,881, entitled, "Electronic Respirator Mask", filed Apr. 28, 2015, the entire contents of which are incorporated herein by reference and relied upon.

FIELD OF THE INVENTION

The present disclosure relates generally to a face mask, and more specifically to an electronic respirator mask that uses a dielectrophoretic filter to filter air that is breathed into and out of the user's mouth and/or nose.

BACKGROUND

Medical face masks are typically used to protect caregivers against droplet-transmitted pathogens and/or as facial protection during patient care activities that are likely to generate splashes or sprays of blood, body fluids, secretions or excretions. Medical face masks are also worn during pandemic events in which an infectious disease spreads across a large region or multiple continents and infects a large number of people.

Standard medical face masks, when worn properly, can reduce the potential exposure of the wearer to blood and body fluids but do not eliminate the risk of contracting any airborne disease or infection. That is, they provide barrier protection against droplets including large respiratory particles, but do not prevent leakage around the edge of the mask when the user inhales.

SUMMARY

The present disclosure is directed to methods and apparatuses that utilize a dielectrophoretic filter to filter air that is breathed into and out of the user's mouth and/or nose. In a general example embodiment, a face mask includes a body sized and shaped to be placed over a user's mouth, the body having an inner volume that surrounds the user's mouth when the body is placed over the user's mouth, a first electrode located on the body, the first electrode configured to allow air to pass between the inner volume of the body and an outside environment when the body is placed over the user's mouth, and a second electrode located on the body, the second electrode configured to allow air to pass between the inner volume of the body and the outside environment when the body is placed over the user's mouth, wherein the first and second electrode create an electric field gradient as air passes between the inner volume of the body and the outside environment.

In another example embodiment, the first electrode and the second electrode are mesh structures.

In another example embodiment, the face mask includes an environmental pollution sensor configured to monitor air quality of the outside environment.

In another example embodiment, the environmental pollution sensor is electrically connected to at least one of the first and second electrodes.

In another example embodiment, at least one of the first and second electrodes is configured to be adjusted based on feedback from the environmental pollution sensor.

In another example embodiment, at least one of the first and second electrodes is adjusted by at least one of: (i) compression or stretching; (ii) heating or cooling; (iii) acoustics; (iv) electromagnetics (v) sonic, infrasonic and/or ultrasonic waves; (vi) electrowetting; and (vii) electrocapillary effect.

In another example embodiment, the environmental pollution sensor is configured to send feedback to an external computer or personal electronic device.

In another example embodiment, the external computer or personal electronic device is configured to control an adjustment of at least one of the first and second electrodes based on the feedback.

In another example embodiment, the adjustment is manually programmed into the external computer or personal electronic device.

In another example embodiment, the face mask includes a respiratory sensor configured to monitor the user's respiration.

In another example embodiment, the respiratory sensor is electrically connected to at least one of the first and second electrodes.

In another example embodiment, the respiratory sensor is electrically connected to at least one of the first and second electrodes.

In another example embodiment, at least one of the first and second electrodes is configured to be adjusted based on feedback from the respiratory sensor.

In another example embodiment, at least one of the first and second electrodes is adjusted by at least one of: (i) compression or stretching; (ii) heating or cooling; (iii) acoustics; (iv) electromagnetics (v) sonic, infrasonic and/or ultrasonic waves; (vi) electrowetting; and (vii) electrocapillary effect.

In another example embodiment, the respiratory sensor is configured to send feedback to an external computer or personal electronic device.

In another example embodiment, the external computer or personal electronic device is configured to control an adjustment of at least one of the first and second electrodes based on the feedback.

In another example embodiment, the adjustment is manually programmed into the external computer or personal electronic device.

In another example embodiment, the adjustment is automatically initiated by the external computer or personal electronic device.

In another example embodiment, the face mask includes a power source

In another example embodiment, the power source is located on the body.

In another example embodiment, the power source can be wirelessly recharged by an external device.

In another example embodiment, the face mask includes an electronic trigger that is activated when the user breathes into the inner volume of the body.

In another example embodiment, the electronic trigger places the power source in electrical communication with at least one of the first electrode, the second electrode, an environmental pollution sensor and a respiratory sensor.

In another example embodiment, the face mask is configured to alternate between a passive state and active state.

In another example embodiment, the active state is triggered when the user breathes into the inner volume of the body.

In another example embodiment, the face mask includes an insulating mesh located between the first electrode and the second electrode.

In another example embodiment, the first electrode is located between the second electrode and the user's mouth when the body is placed over the user's mouth.

In another example embodiment, at least one of the first electrode and the second electrode is circular.

In a general example embodiment, a face mask includes a body sized and shaped to be placed over a user's mouth, the body having an inner volume that surrounds the user's mouth when the body is placed over the user's mouth, an environmental pollution sensor located on the body and configured to monitor air quality of an outside environment, and a dielectrophoretic filter located on the body, the dielectrophoretic filter configured to allow air to pass between the inner volume of the body and the outside environment when the body is placed over the user's mouth, wherein the dielectrophoretic filter is adjustable based on feedback from the environmental pollution sensor.

In another example embodiment, the dielectrophoretic filter includes a first electrode and a second electrode, and wherein at least one of the first electrode and second electrode is adjustable based on the feedback from the environmental pollution sensor.

In another example embodiment, at least one of the first and second electrodes is adjusted by at least one of: (i) compression or stretching; (ii) heating or cooling; (iii) acoustics; (iv) electromagnetics (v) sonic, infrasonic and/or ultrasonic waves; (vi) electrowetting; and (vii) electrocapillary effect.

In another example embodiment, the environmental pollution sensor is electrically connected to at least one of the first and second electrodes.

In another example embodiment, the environmental pollution sensor is configured to send the feedback to an external computer or personal electronic device.

In another example embodiment, the external computer or personal electronic device controls the adjustment of the dielectrophoretic filter based on the feedback.

In another example embodiment, the adjustment is manually programmed into the external computer or personal electronic device.

In another example embodiment, the adjustment is automatically initiated by the external computer or personal electronic device.

In another example embodiment, the face mask includes a respiratory sensor located on the mask and configured to monitor air quality within the inner volume.

In another example embodiment, the adjustment is based on a combination of feedback from the environmental pollution sensor and the respiratory sensor.

In a general example embodiment, a face mask includes a body sized and shaped to be placed over a user's mouth, the body having an inner volume that surrounds the user's mouth when the body is placed over the user's mouth, a respiratory sensor located on the mask and configured to monitor the user's respiration, and a dielectrophoretic filter located on the body, the dielectrophoretic filter configured to allow air to pass between the inner volume of the body and the outside environment when the body is placed over the user's mouth, wherein the dielectrophoretic filter is adjustable based on feedback from the respiratory sensor.

In another example embodiment, the dielectrophoretic filter includes a first electrode and a second electrode, and wherein at least one of the first electrode and second electrode is adjustable based on the feedback from the respiratory sensor.

In another example embodiment, the at least one of the first and second electrodes is adjusted by at least one of: (i) compression or stretching; (ii) heating or cooling; (iii) acoustics; (iv) electromagnetics (v) sonic, infrasonic and/or ultrasonic waves; (vi) electrowetting; and (vii) electrocapillary effect.

In another example embodiment, the respiratory sensor is electrically connected to at least one of the first and second electrodes.

In another example embodiment, the respiratory sensor is configured to send the feedback to an external computer or personal electronic device.

In another example embodiment, the external computer or personal electronic device controls the adjustment of the dielectrophoretic filter based on the feedback.

In another example embodiment, the adjustment is manually programmed into the external computer or personal electronic device.

In another example embodiment, the adjustment is automatically initiated by the external computer or personal electronic device.

In another example embodiment, the face mask includes an environmental pollution sensor located on the body and configured to monitor air quality of an outside environment.

In another example embodiment, the adjustment is based on a combination of feedback from the respiratory sensor and the environmental pollution sensor.

In a general example embodiment, a face mask includes a body sized and shaped to be placed over a user's mouth, the body having an inner volume that surrounds the user's mouth when the body is placed over the user's mouth, and means for dielectrophoretically suspending particles that pass between the inner volume and an outside environment when the body is placed over the user's mouth.

In another example embodiment, the face mask includes means for monitoring air quality of the outside environment.

In another example embodiment, the face mask includes means for monitoring the user's respiration.

In another example embodiment, the face mask includes means for supplying power to the means for dielectrophoretically suspending particles.

In another example embodiment, the face mask includes means for recharging the means for supplying power.

In another example embodiment, the face mask includes means for adjusting the means for dielectrophoretically suspending particles.

In a general example embodiment, a method of using a face mask includes placing a body over a user's mouth so that an inner volume of the body surrounds the user's mouth, the body including a dielectrophoretic filter sized and shaped to allow air to pass between the inner volume of the body and the outside environment when the body is placed over the user's mouth, causing the dielectrophoretic filter to create an electric field gradient as air passes between the inner volume of the body and the outside environment, and breathing air from the outside environment through the dielectrophoretic filter.

In another example embodiment, causing the dielectrophoretic filter to create an electric field gradient includes breathing into the inner volume.

In another example embodiment, causing the dielectrophoretic filter to create an electric field gradient includes activating an electronic trigger.

In another example embodiment, the method includes monitoring air quality of the outside environment.

In another example embodiment, the method includes adjusting an electrode of the dielectrophoretic filter based on the air quality of the outside environment.

In another example embodiment, the method includes monitoring the user's respiration.

In another example embodiment, the method includes adjusting an electrode of the dielectrophoretic filter based on the user's respiration.

BRIEF DESCRIPTION OF THE FIGURES

Embodiments of the present disclosure will now be explained in further detail by way of example only with reference to the accompanying figures, in which.

DETAILED DESCRIPTION

Figure 1:
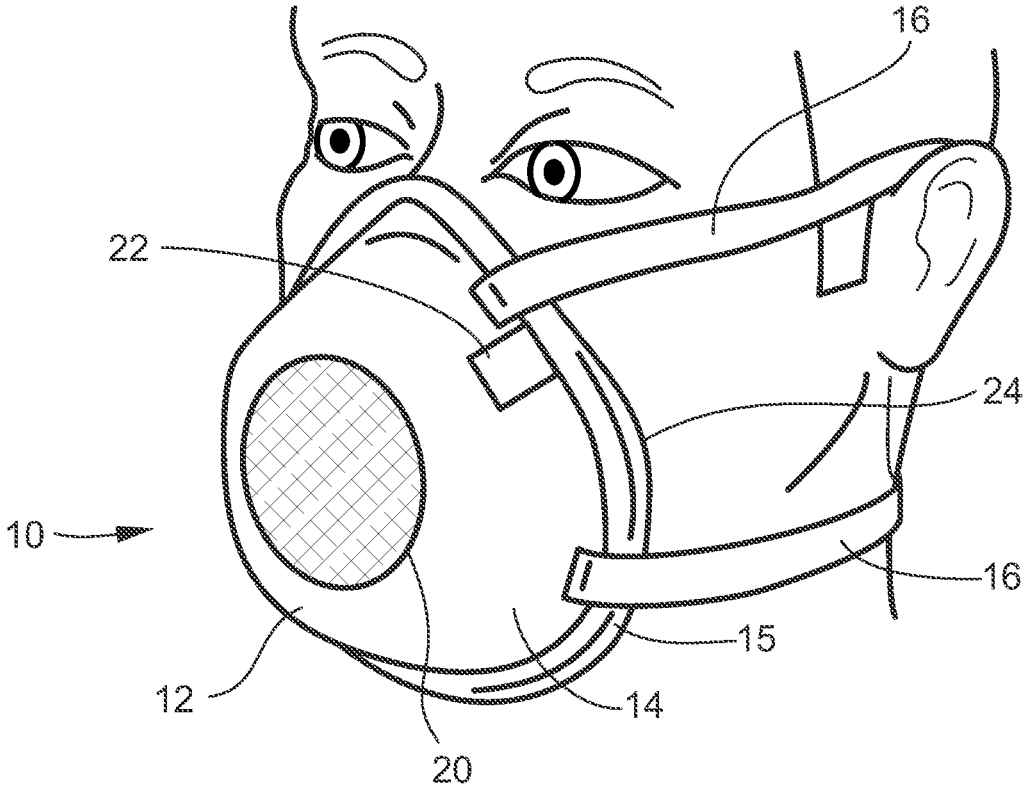
FIG. 1 shows a front perspective view of an embodiment of a face mask according to the present disclosure.
Figure 2:
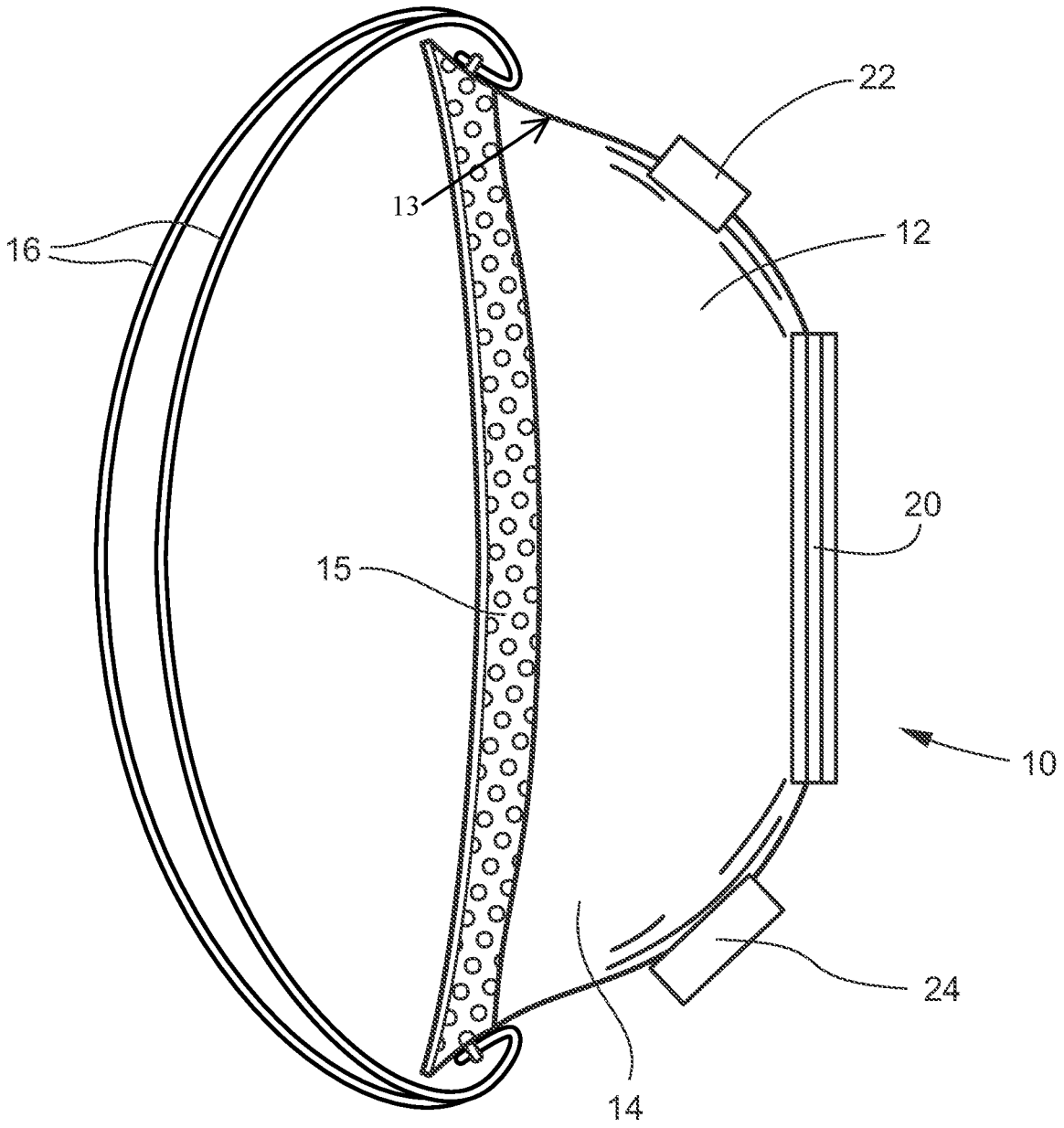
FIG. 2 shows a side elevational view of an embodiment of a face mask according to the present disclosure.

Before the disclosure is described, it is to be understood that this disclosure is not limited to the particular apparatuses and methods described. It is also to be understood that the terminology used herein is for the purpose of describing particular embodiments only, and is not intended to be limiting, since the scope of the present disclosure will be limited only to the appended claims.

As used in this disclosure and the appended claims, the singular forms "a," "an" and "the" include plural referents unless the context clearly dictates otherwise. The methods and apparatuses disclosed herein may lack any element that is not specifically disclosed herein. Thus, "comprising," as used herein, includes "consisting essentially of" and "consisting of."

FIGS. 1 to 4 illustrate alternative embodiments of a face mask 10 according to the present disclosure. In the illustrated embodiments, mask 10 includes a body 12 that can be secured over a user's mouth and/or nose, for example, by tying or looping one or more attachment straps 16 around the user's head or ears. A dielectrophoretic filter 20, an environmental pollution sensor 22 and a respiratory sensor 24 are each located on body 12. When mask 10 is being used, the positioning of body 12 on a user's face locates the dielectrophoretic filter 20 over the user's mouth and/or nose so that the dielectrophoretic filter 20 can filter the air that is breathed into and out of the user's mouth and/or nose. The positioning of the environmental pollution sensor 22 allows the environmental pollution sensor 22 to monitor the air quality of the environment outside of mask 10, and the positioning of the respiratory sensor 24 allows the respiratory sensor 24 to monitor the user's own respiration. As illustrated in FIGS. 1 to 4, the configurations of dielectrophoretic filter 20, environmental pollution sensor 22 and respiratory sensor 24 in relation to each other and body 12 can differ.

In an embodiment, body 12 has a cup-shaped form that fits over the user's nose and preferably also the user's chin. When body 12 is placed over the user's mouth and/or nose, an inner surface 13 of body 12 faces the user's face, and an outer surface 14 of body 12 faces away from the user's face. That is, inner surface 13 is the surface inside of the cup-shape, and the outer surface 14 is the surface outside of the cup-shape. The inner surface 13 forms an inner volume that surrounds the user's mouth and/or nose when the body is placed over the user's mouth and/or nose.

Body 12 can be made of one or more layers of any suitable material, for example, a paper material or a woven or non-woven fabric material. As will be understood by those of ordinary skill in the art, the material portion of body 12 should not be permeable to air, because all air breathed in and out by the user while wearing mask 10 should pass through the dielectrophoretic filter 20. Accordingly, the outer border 15 of body 12 is preferably sized and shaped so as to press against the user's face so that air cannot pass back and forth between the inner volume within the mask 10 and the outside environment unless the air passes through dielectrophoretic filter 20. For this purpose, body 12 can be made to match the contour of a user's face, or at least outer border 15 can be made of a flexible or elastic material capable of forming to the user's face once placed on the user. Attachment straps 16 can also be used to pull body 12 to match the contour of the patient's face. In an embodiment, the inner surface 13 and/or outer edge 15 of body 12 can include padding that presses against the user's face to increase the comfort of mask 10.

As illustrated in FIGS. 1 to 4, dielectrophoretic filter 20 is located in a central portion of body 12 so that dielectrophoretic filter 20 is located adjacent to the user's mouth and/or nose when body 12 is fitted to the user's face. Once mask 10 has been positioned over the user's mouth and/or nose, dielectrophoretic filter 20 can filter the air that is breathed into and out of the patient's mouth and/or nose using the principle of dielectrophoresis. With dielectrophoresis, polarizable particles can be suspended in a non-uniform electric field. The electric field polarizes the particles, and the poles experience a force along field lines, which can be either attractive or repulsive. Since the field is non-uniform, the pole experiencing the greatest electric field will dominate the other, and the polarized particle will be suspended. If the polarized particle moves in the direction of the increasing electric field, the behavior is referred to as positive dielectrophoresis. If acting to move the particle away from the high field regions, the behavior is referred to as negative dielectrophoresis.

A dielectrophoretic filter system therefore requires an electrode system that becomes filled with dielectric particles, for example, microbes or other contaminants. In the illustrated embodiment, dielectrophoretic filter 20 provides the electrode system in the form of a first electrode 32 and a second electrode 36, and the dielectric particles are microbes contained in the air that is breathed into and out of the patient's mouth and/or nose. Dielectrophoretic filter 20 can suspend the microbes so that they are filtered out of the air that that is breathed in and out by the user of the mask 10, that is, the air that passes back and forth between the outside environment and the inner volume formed by inner surface 13.

Figure 5:
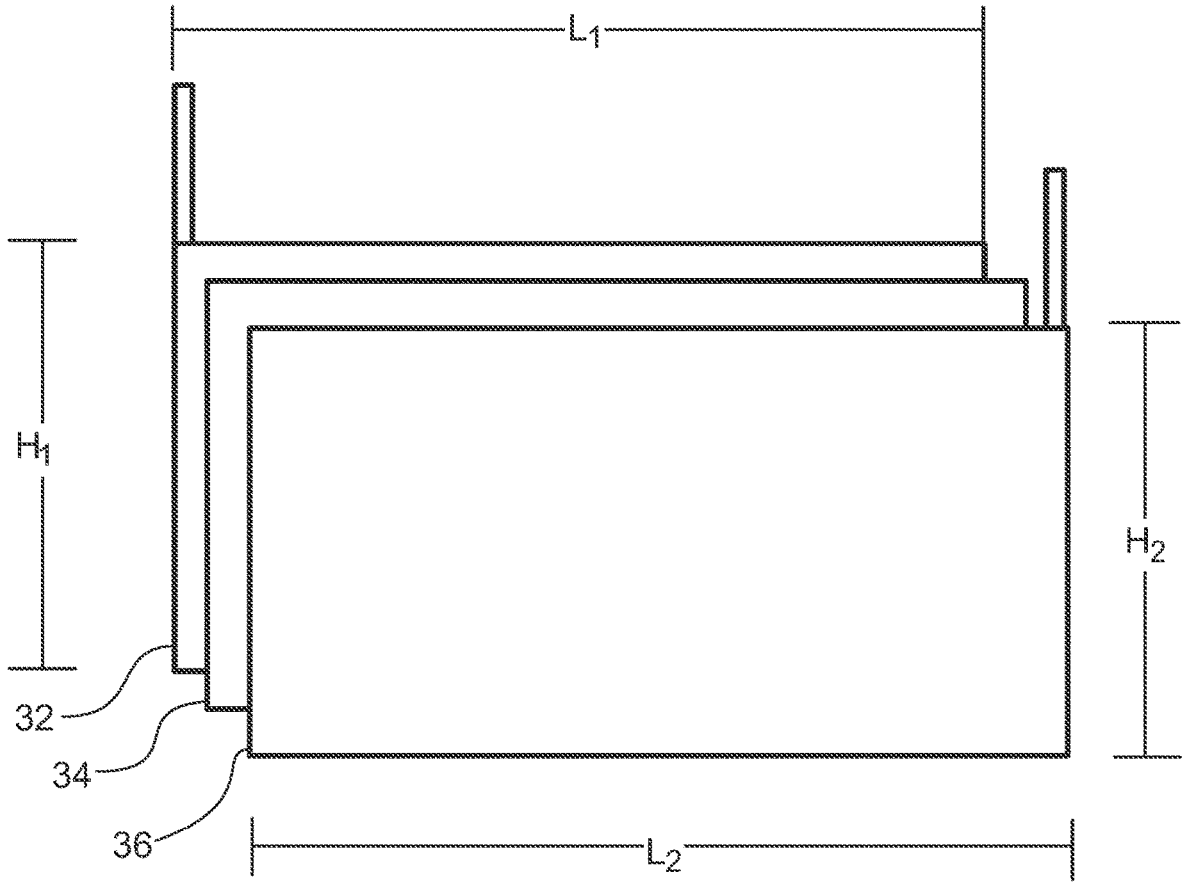
FIG. 5 shows an exploded view of an embodiment of a dielectrophoretic filter that can be used with the face mask of FIGS. 1 to 4.

FIG. 5 illustrates an embodiment of a dielectrophoretic filter 20. In the illustrated embodiment, dielectrophoretic filter 20 includes a first electrode 32, an insulator mesh 34 and a second electrode 36. In an embodiment, each of the first electrode 32, the insulator mesh 34 and the second electrode 36 are formed of an air-permeable, mesh or grid-like, porous structure that allows the user of the mask 10 to breath through the dielectrophoretic filter 20. First electrode 32 and second electrode 36 can be formed of any suitable conductive material, for example, silver, copper, gold, aluminum, zinc, nickel, brass, bronze, iron, platinum, steel, lead, metamaterials and/or the like or combinations thereof. If an AC electric field is used, then the first electrode 32 and the second electrode 36 can be made from the same material. If a DC electric field is used, then the first electrode 32 and the second electrode 36 can be made of different materials, preferably galvonic couples from different materials. It has been determined that Zn—Cu, Al—Cu and Al—Ag are advantageous galvonic couples. Insulator mesh 34 can be formed of any suitable insulation material and is used to prevent short-circuits between the first electrode 32 and the second electrode 36. Those of ordinary skill in the art will recognize that other, similar materials can be used for each of first electrode 32, insulator mesh 34 and second electrode 36.

In a preferred embodiment, one of the first electrode 32 and second electrode 36 is formed of a copper porous structure, and the other of the first electrode 32 and second electrode 36 is formed of a zinc, aluminum, silver or stainless steel porous structure.

In another preferred embodiment, one of the first electrode 32 and second electrode 36 is formed of a copper porous structure with silver nanoparticles on the surface thereof. For example, the copper porous structure can include copper wires that form a porous structure, and the silver nanoparticles can be added to the copper wires.

For dielectrophoretic filter 20 to be functional, an electric field gradient must be created between the first electrode 32 and the second electrode 36. The electric field gradient can be created by using different three-dimensional shapes for the first electrode 32 and the second electrode 36. In an embodiment, the first electrode 32 and the second electrode 36 have the same cross-sectional size or shape, but differ in longitudinal shape. The shapes can be formed according to the following formula from Gauss's law in electrostatics: Constant=$E_1S_1=E_2S_2$, wherein E is the electric field and S is the cross-section.

Figure 6:
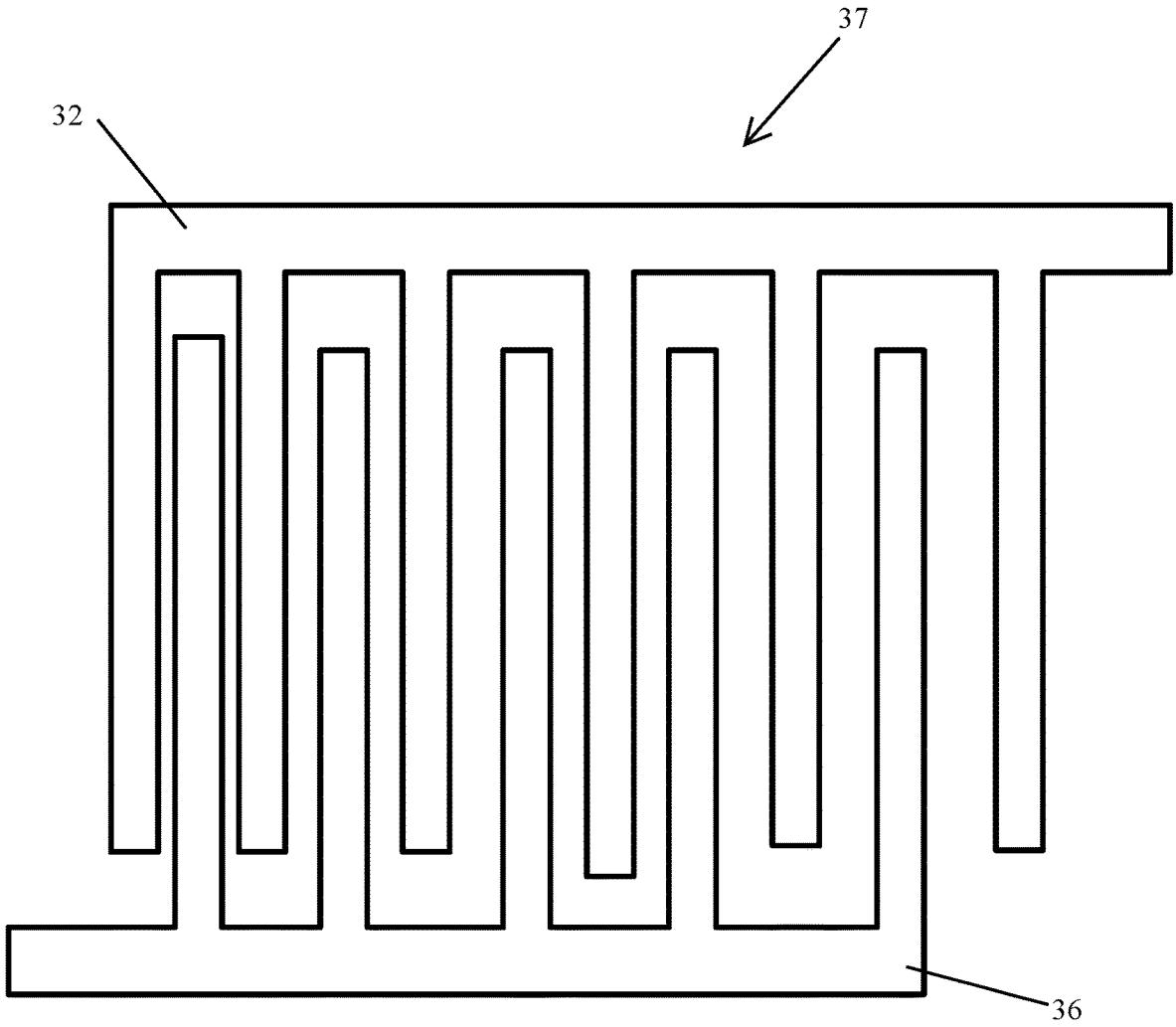
FIG. 6 shows an embodiment of a counter interdigital electrode configuration that can be used with the face mask of FIGS. 1 to 4.
Figure 7:
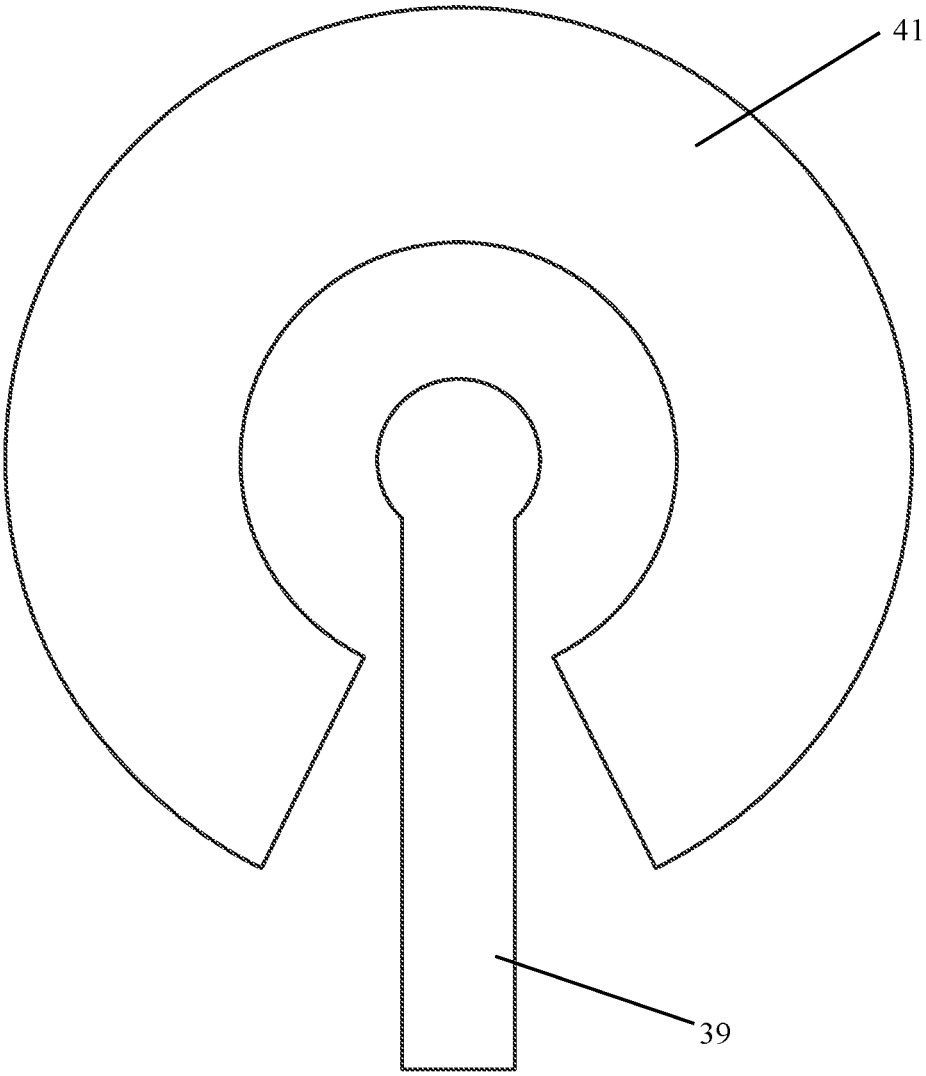
FIG. 7 shows another embodiment of an electrode configuration that can be used with the face mask of FIGS. 1 to 4, which has a central pin electrode and counter electrode.

FIGS. 6 and 7 show example configurations of first electrode 32 and second electrode 36. FIG. 6 shows a counter interdigital electrode configuration 37 that can be used to generate an AC electric field gradient. FIG. 7 shows an electrode configuration which uses non-uniform shapes, that is, a central pin electrode 39 and counter electrode 41. The non-uniform shape is used to create the electric field gradient.

Using the above principles, dielectrophoretic filter 20 can be used to filter any microbe particles from the air that passes back and forth between the outside environment and the inner volume formed by inner surface 13. Dielectrophoretic filter 20 is particularly suited to filter 3M microbe particles.

In an embodiment, mask 10 can also include one or more layers of a woven or nonwoven filter material to assist dielectrophoretic filter 20 in filtering microbes or other airborne contaminants from the air breathed through dielectrophoretic filter 20. In an embodiment, the filter material includes a nonwoven polypropylene material to filter any microbes or other airborne contaminants that are not filtered by dielectrophoretic filter 20. In an embodiment, mask 10 can include a first layer of filter material such as a nonwoven polypropylene material on one side of the first electrode 32 and the second electrode 36, and/or a second layer of filter material such as a nonwoven polypropylene material on the other side of first electrode 32 and the second electrode 36, effectively sandwiching the first electrode 32 and the second electrode 36 between layers of polypropylene material. Those of ordinary skill in the art will recognize other configurations that use the filter material to assist dielectrophoretic filter 20 in filtering microbes or other airborne contaminants from the air breathed through dielectrophoretic filter 20.

In an embodiment, first electrode 32 and second electrode 36 are formed so that they are removeable from body 12 and can be interchanged with other electrodes that are formed of different materials and/or different shapes and/or that have different coatings. In an embodiment, first electrode 32 is made from aluminum foil having a 10 cm2 area with perforated holes having a diameter of 100 micron and a density of 10 holes per cm2, and second electrode 36 is made from copper mesh having a 10 cm2 area with holes having a diameter of 100 micron and a density of 20 holes per cm2. In this embodiment, the distance between the electrodes can be 200 micron, and the shape of the copper electrode can be circular on a flat surface. Insulator mesh 34 can be made from a porous polypropylene nonwoven material. In another embodiment, first electrode 32 and second electrode 36 can have a counter interdigital shape. First electrode 32 can be made from aluminum foil and second electrode 36 can be made from stainless steel. First electrode 32 and second electrode 36 can each have a 50 micron diameter with a 50 micron distance between electrodes. Those of ordinary skill in the art will recognize other suitable shapes, sizes and materials that can be used to form a mask 10 according to the present disclosure.

Figure 3:
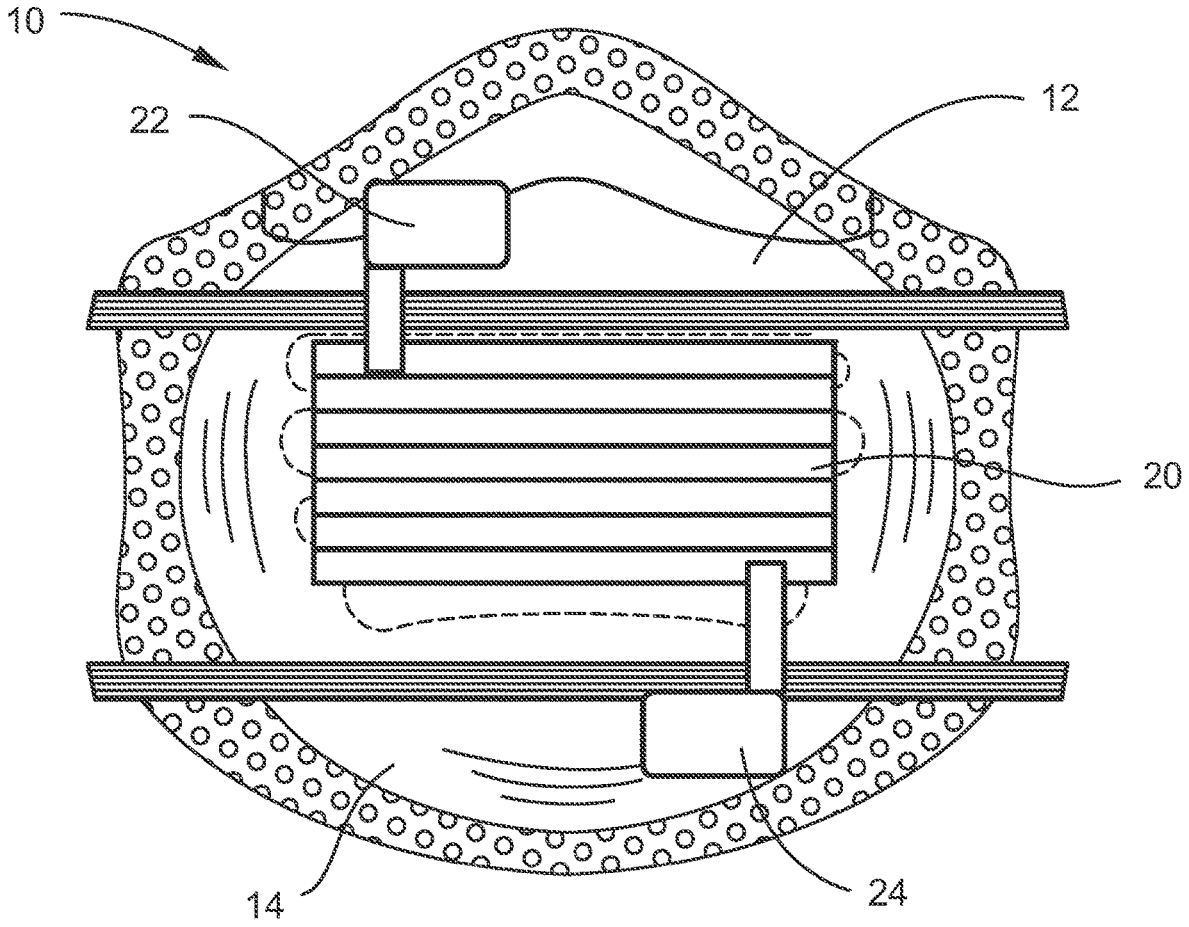
FIG. 3 shows a front elevational view of an embodiment of a face mask according to the present disclosure.
Figure 4:
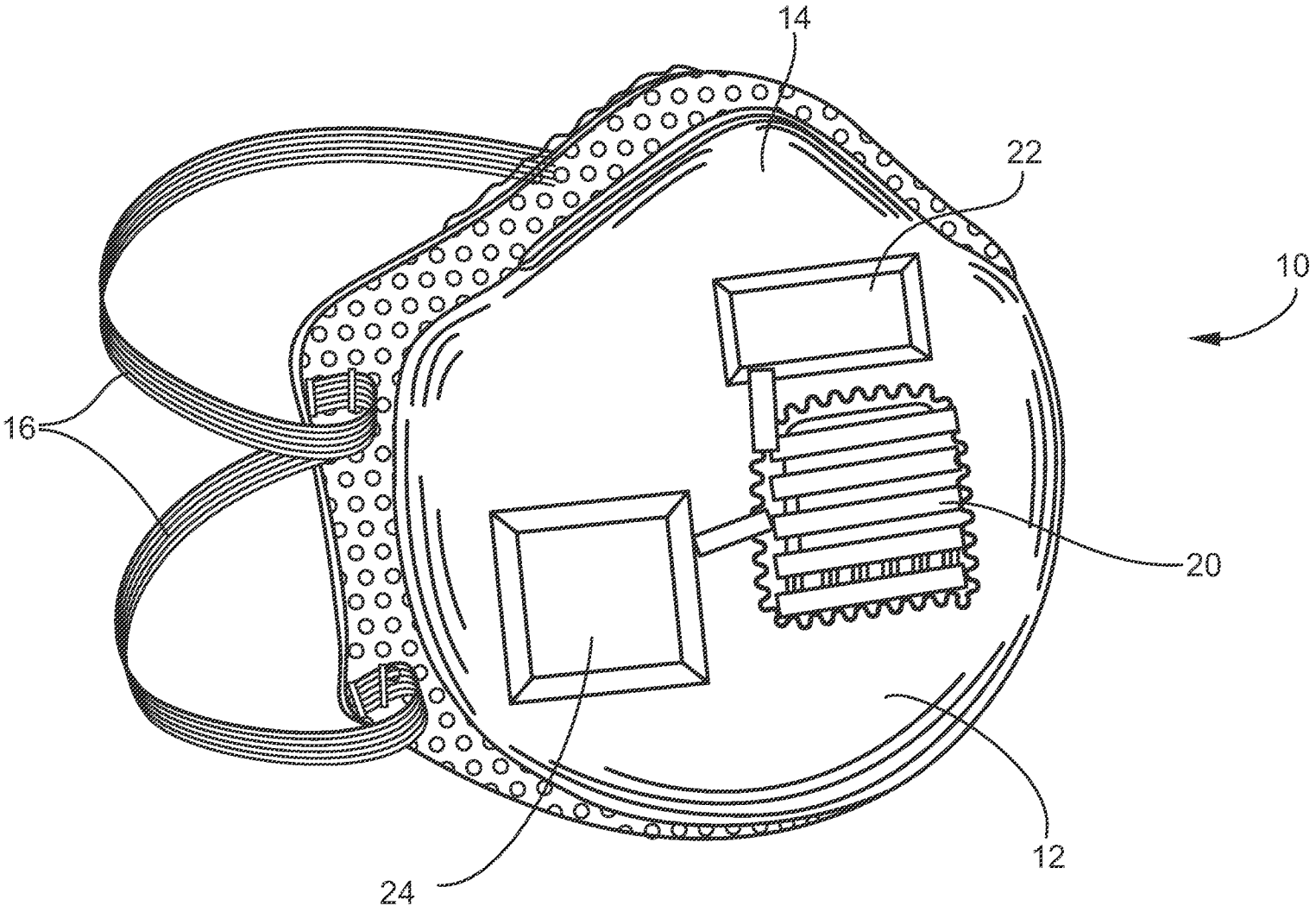
FIG. 4 shows a front perspective view of an embodiment of a face mask according to the present disclosure.

In another embodiment, the physical state of first electrode 32 and second electrode 36 can be adjusted, without being removed from body 12, based on the outside environment or the user and/or the environment inside the inner volume formed by inner surface 13. In an embodiment, and as illustrated in FIG. 3, first electrode 32 and/or second electrode 36 each have a height $H_1$, $H_2$ and a length $L_1$, $L_2$ that can be stretched and/or compressed to change the size of the pores (not shown in FIG. 3) in each electrode. For example, by compressing the height $H_1$, $H_2$ (y-direction) of one of the electrodes and stretching the length $L_1$, $L_2$ (x-direction) of the same electrode, the material can switch between an x-polarized state and a y-polarized state, which alters the electrical field gradient between the electrodes and therefore alters how the microbes are suspended by the electrodes. In another embodiment, electrowetting and/or an electrocapillary effect can be used to make adjustments to mask 10. The size of the pores can be adjusted by changing the contact angle and/or shape of water droplet condensation under the electric field, for example, if water condensation appears in a single pore during a breathing period.

The physical state of the first electrode 32 and the second electrode 36 can also be adjusted by other methods, for example, by heating or cooling the electrode material, by using acoustics, and/or by using electromagnetic, sonic, infrasonic and/or ultrasonic waves. In an embodiment, an electrode coating can also be used, for example, an electro conductive polymer coating such as Nafion, polystyrene sulfonic acid or another organic polymer.

As illustrated in FIGS. 1 to 4, mask 10 can also include sensors that provide feedback about the air passing through and/or located inside (within the inner volume) or outside (the outside environment) of body 12. In the illustrated embodiment, mask 10 includes an environmental pollution sensor 22 and respiratory sensor 24, which can be used together or separately. In a preferred embodiment, environmental pollution sensor 22 can be used to monitor the air quality of the environment outside of mask 10, and respiratory sensor 24 can be used to monitor the user's own respiration. Feedback from each of these sensors can then be used for various reasons, for example, to alert the user of the mask 10 or others as to the air quality conditions that the user is experiencing, and/or to adjust the first electrode 32 and/or second electrode 36 and/or another component of the mask 10 to an optimized working setting for the environment based on the sensed air quality conditions.

Mask 10 requires relatively little power to operate, for example, as little as one volt of energy. In the illustrated embodiment, mask 10 is self-powered by the chemical reaction caused by the user breathing through dielectrophoretic filter 20. That is, mask 10 is inactive until the user breathes through the first and second electrodes of dielectrophoretic filter 20. When the user breathes through dielectrophoretic filter 20, dielectrophoretic filter 20 acts as a power source 40, such that a separate power source is not needed in addition to the electrodes.

In an alternative embodiment, mask 10 can include a separate power source 40 to power the electronic components of mask 10, such as dielectrophoretic filter 20, environmental pollution sensor 22 and/or respiratory sensor 24. Power supply 40 can be located on body 12, or power supply can be located at a remote location and wirelessly supply power to dielectrophoretic filter 20, environmental pollution sensor 22 and/or respiratory sensor 24. If power supply 40 is located on body 12, power supply 40 can be, for example, a rechargeable battery that can be charged, for example, by a cellular phone or battery charger.

In one embodiment, mask 10 is configured to receive feedback from environmental pollution sensor 22 and/or respiratory sensor 24 and set the filtration parameters of dielectrophoretic filter 20 based on the feedback. For example, mask 10 can be configured with an adjustment mechanism 46 that adjusts the first electrode 32 and/or the second electrode by stretching and/or compressing the height and/or length of the first electrode 32 and/or the second electrode to change the size and/or shape of the electrode and/or the size of the pores in the electrode. In another embodiment, adjustment mechanism 46 can adjust the first electrode 32 and/or the second electrode 36 by heating or cooling the electrode material, by using acoustics, and/or by using electromagnetic, sonic, infrasonic and/or ultrasonic waves. In either embodiment, mask 10 can include a controller that automatically controls adjustment mechanism 46 to perform the adjustment when certain parameters are met in the feedback from environmental pollution sensor 22 and/or respiratory sensor 24. The conductivity of the mask media can also be used as a sensed parameter that affects adjustment. In an embodiment, mask 10 can alter the electric signals (e.g., AC pulse, 1 sec, 1V) when the conductivity of the media in the mask changes significantly (e.g., 20%).

In another embodiment, mask 10 is wirelessly connected to an external computer or personal electronic device ("PED") 38. Computer/PED 38 can be operably connected to one or more of dielectrophoretic filter 20, environmental pollution sensor 22 and respiratory sensor 24, and can be used to set the filtration parameters of dielectrophoretic filter 20 based on readouts from environmental pollution sensor 22 and/or respiratory sensor 24. In an embodiment, a display screen on computer/PED 38 displays the parameters that are fed to computer/PED 38 to a user, and the user then wirelessly controls adjustment mechanism 46 from the computer/PED 38 to adjust the first electrode 32 and/or the second electrode 36 as described above. In another embodiment, computer/PED 38 can be programmed to suggest certain adjustments to the user based on feedback from the environmental pollution sensor 22 and/or respiratory sensor 24, and the user can simply choose between the suggested adjustments and/or confirm a suggested adjustment to be performed by adjustment mechanism 46. In an embodiment, computer/PED 38 can also be used to recharge a power source 40 on the device using, for example, wireless power transfer, induction coils, or another power transfer method known in the art.

In an embodiment, environmental pollution sensor 22 can sense the presence and/or concentration of airborne particles indicative of different infectious diseases, pollutants, chemical agents and dangerous gases in the outside environment. In an embodiment, the environmental pollution sensor 22 can include a moisture sensor configured to monitor the moisture in the outside environment.

Figure 8:
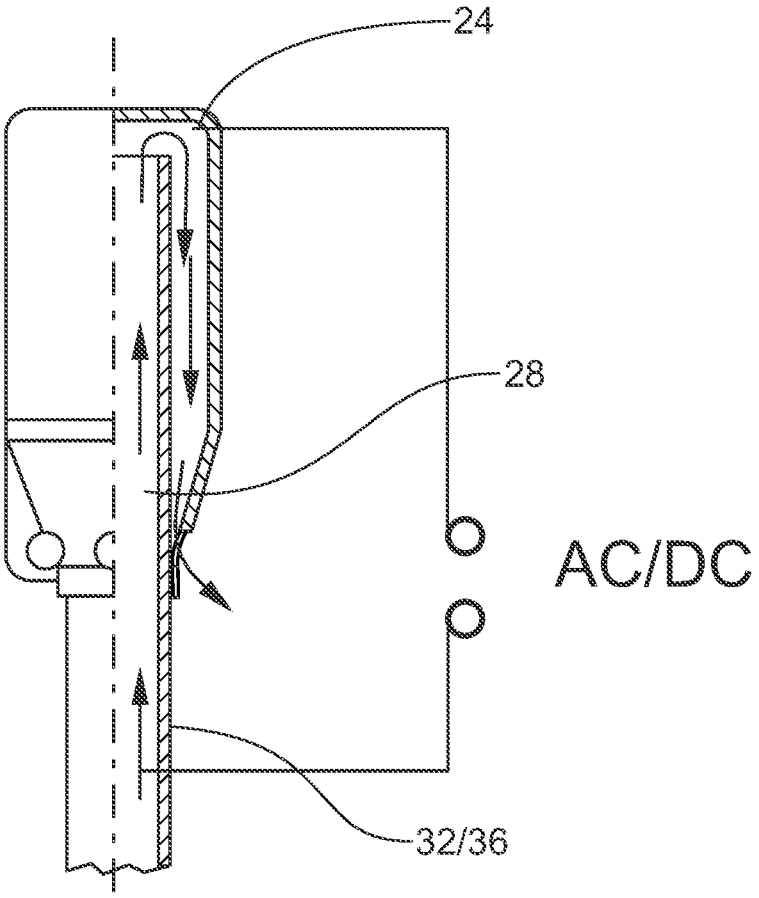
FIG. 8 shows a cross-sectional view of an embodiment of a respiratory sensor that can be used with the face mask of FIGS. 1 to 4.

In an embodiment, respiratory sensor 24 can be used to monitor the user's breathing, for example, by detecting the flow of the user's breath, or the presence or concentration of particular particles within the user's breath. FIG. 8 illustrates an embodiment of a respiratory sensor 24. As illustrated, respiratory sensor 24 can be a pipe-like filter with coaxial electrodes inside and outside of the breathing pipe. Respiratory sensor 24 can send and receive AC or DC power to or from at least one of the first electrode 32 and/or the second electrode 36, and can receive air from inside body 12 through a passage 28 along body 12. In an embodiment, the respiratory sensor 24 can include a moisture sensor configured to monitor the moisture in the user's breath.

In an embodiment, the feedback from the environmental pollution sensor 22 can be combined with the feedback from the respiratory sensor 24 to determine whether the user is at risk. For example, an alert can be issued to the user when one or both of environmental pollution sensor 22 and respiratory sensor 24 detects data that reaches a predetermined threshold. In an embodiment, certain thresholds can be dependent on the reading from environmental pollution sensor 22 in view of the reading from respiratory sensor 24, the reading from respiratory sensor 24 in view of the reading from environmental pollution sensor 22, the reading from one or both of environmental pollution sensor 22 and respiratory sensor 24 in view of the reading from another sensor, and/or the reading from another sensor in view of the reading from one or both of environmental pollution sensor 22 and respiratory sensor 24.

In an embodiment, mask 10 also includes a positioning sensor 26 such as a global positioning system ("GPS") sensor or radio-frequency identification ("RFID") sensor that can be used to locate the mask 10 when the mask 10 is in use. Positioning sensor 26 can be used, for example, to correlate feedback from environmental pollution sensor 22 with the location of the mask to determine the air quality at that location. In an embodiment, that correlated information can be aggregated with similar data from other masks or to, for example, obtain multiple air quality readings from a general location or adjust other masks in a similar location based on the feedback from mask 10. Positioning sensor 26 can also be used, for example, to adjust dielectrophoretic filter 20, environmental pollution sensor 22 and/or respiratory sensor 24 based on information obtained regarding the location of the mask 10, for example, information obtained from a third party weather service. In an embodiment, positioning sensor 26 can be used to inform the user that the user is located within or nearby a contaminated area. This feature is particularly advantageous if the respiratory sensor 24 is not functioning properly.

In an embodiment, the user of nasal device 10 can take a picture of his or her own face while wearing mask 10, and a computer-based application associated with the camera can analyze the dielectrophoretic filter 20, environmental pollution sensor 22 and/or respiratory sensor 24. The application can analyze the dielectrophoretic filter 20, for example, to determine whether the dielectrophoretic filter 20 needs to be changed. The application can analyze the environmental pollution sensor 22 and/or respiratory sensor 24, for example, to provide feedback to the user regarding the sensor readings. The application can also upload data regarding the sensor readings so that other users of the application can view the data. In an embodiment, the application aggregates sensor information from a plurality of masks 10, so that the application can, for example, warn of hazardous conditions in an area. The application can also provide updates to the user of known air quality conditions in a particular area. The camera application is advantageous, for example, because it allows the user to analyze mask 10 without having to remove mask 10. In an embodiment, the application is a cellular phone application.

Mask 10 is advantageously configured to minimize power consumption by alternating between passive and active states. The passive state occurs while mask 10 is not being worn, and in the passive state dielectrophoretic filter 20 and/or a separate power source 40 does not supply power to one or more of dielectrophoretic filter 20, environmental pollution sensor 22, respiratory sensor 24 and positioning sensor 26. The active state occurs once a user has placed mask 10 over his or her mouth and starts breathing, and in the active state dielectrophoretic filter 20 and/or a separate power source 40 provides power to one or more of dielectrophoretic filter 20, environmental pollution sensor 22, respiratory sensor 24 and positioning sensor 26. By alternating between the passive and active states, the mask 10 ensures that power is only consumed when a user is wearing the mask 10.

Figure 9:
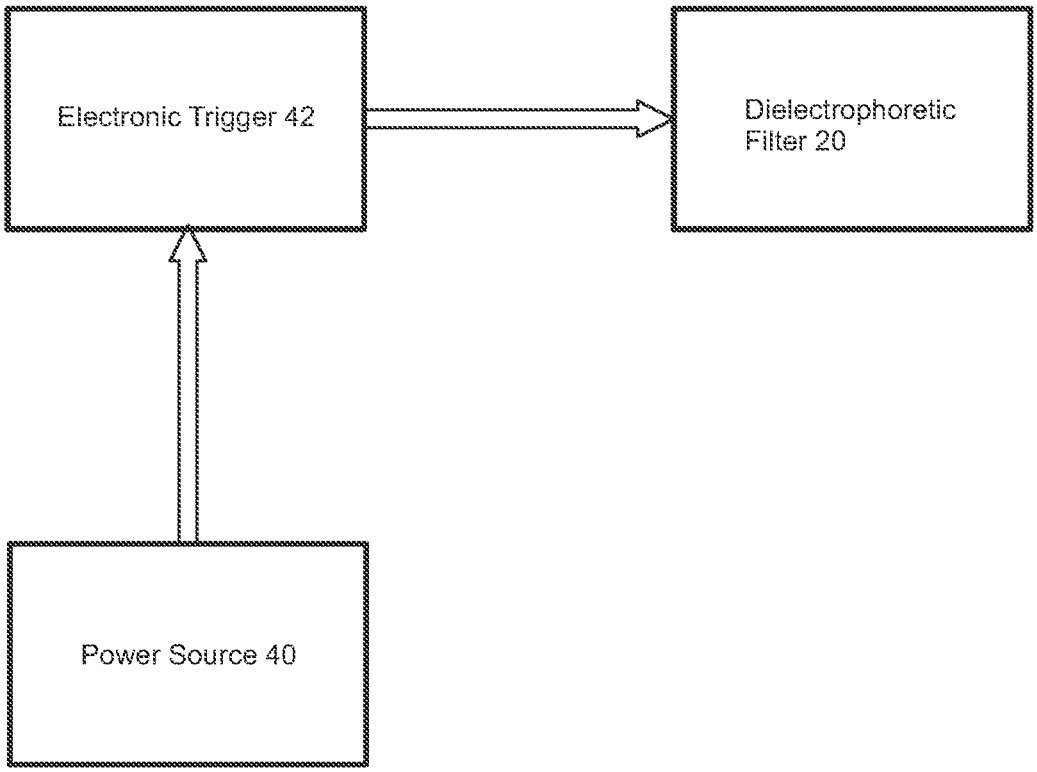
FIG. 9 shows an electrical flow chart that depicts an embodiment of the electronics that can be used with the face mask of FIGS. 1 to 4.

To alternative between the passive and active states, mask 10 includes an electronic trigger 42 that is activated when the user breathes into mask 10. Electronic trigger 42 operates in threshold regimes, for example, an electric pulse (~1V) can start dielectrophoretic trapping at a certain predetermined level of contaminates. FIG. 9 shows an embodiment of how the electronic trigger 42 works to connect dielectrophoretic filter 20 and/or a separate power supply 40 when the electronic trigger 42 is activated.

Figure 10:
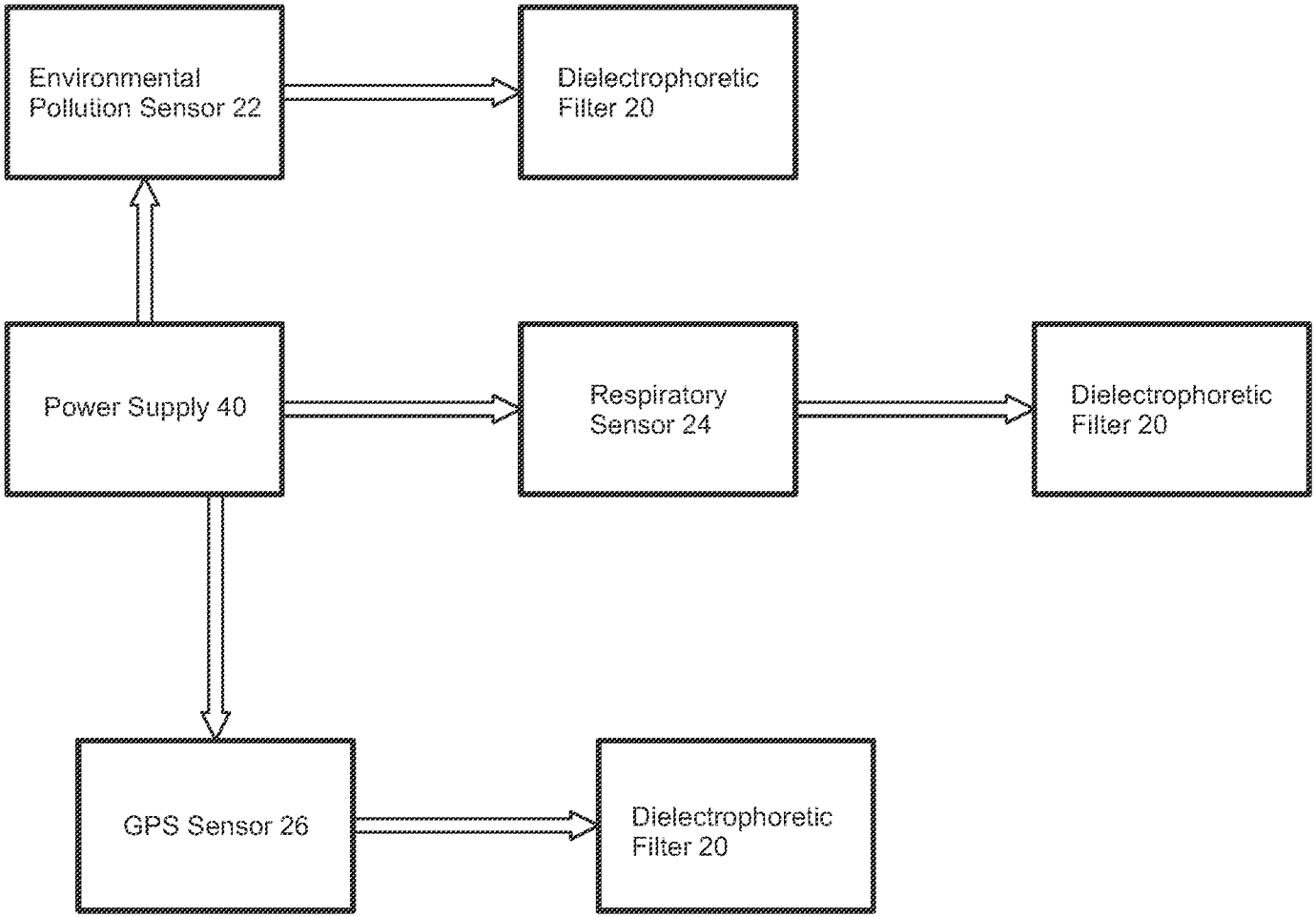
FIG. 10 shows an electrical flow chart that depicts an embodiment of the electronics that can be used with the face mask of FIGS. 1 to 4.

FIG. 10 illustrates a flow chart showing an embodiment of a communication scheme between power source 40 and the dielectrophoretic filter 20, the environmental pollution sensor 22, the respiratory sensor 24 and the positioning sensor 26. As illustrated, power source 40 is connected to each of the environmental pollution sensor 22, the respiratory sensor 24 and the positioning sensor 26, and each of the sensors are connected to the electrode system of dielectrophoretic filter 20. In an embodiment, dielectrophoretic filter 20 and/or a separate power source 40 switches on the positioning sensor 26 when mask 10 receives information about local pollution, dielectrophoretic filter 20 and/or a separate power source 40 switches on the respiratory sensor 24 when mask 10 receives information about filter blockage, and/or dielectrophoretic filter 20 and/or a separate power source 40 switches on the environmental pollution sensor 22 when mask 10 receives information pollution.

Modifications in addition to those described above may be made to the structures and techniques described herein without departing from the spirit and scope of the disclosure. Accordingly, although specific embodiments have been described, these are examples only and are not limiting on the scope of the disclosure.

What is claimed is:

1. A face mask comprising: a body sized and shaped to be placed over a user's mouth, the body having an inner volume that surrounds the user's mouth when the body is placed over the user's mouth; a first electrode located on the body, the first electrode configured to allow air to pass between the inner volume of the body and an outside environment when the body is placed over the user's mouth; and a second electrode located on the body, the second electrode configured to allow air to pass between the inner volume of the body and the outside environment when the body is placed over the user's mouth, wherein the first and second electrodes create an electric field gradient as air passes between the inner volume of the body and the outside environment; and an insulating mesh located between the first electrode and the second electrode; said mask activated when breathing through the first and the second electrodes; said mask filtering microbes of infectious disease from air passed between said outside environment and said inner volume of the body; said face mask operational with one volt; and said mask wirelessly connected to an external computer or personal electronic device.

2. The face mask of claim 1, wherein the first electrode and the second electrode include mesh structures.

3. The face mask of claim 1, wherein at least one of the first and second electrodes is configured to be adjusted based on feedback from a sensor.

4. The face mask of claim 3, wherein the at least one of the first and second electrodes is adjusted by at least one of: (i) compression or stretching; (ii) heating or cooling; (iii) acoustics; (iv) electromagnetics (v) sonic, infrasonic and/or ultrasonic waves; (vi) electrowetting; and (vii) electrocapillary effect.

5. The face mask of claim 3, wherein the sensor includes at least one of an environmental pollution sensor configured to monitor air quality of an outside environment and a respiratory sensor configured to monitor the user's respiration.

6. The face mask of claim 1, which is configured to alternate between a passive state and an active state.

7. The face mask of claim 1, wherein an active state is triggered when the user breathes into the inner volume of the body.

8. A face mask comprising: a body sized and shaped to be placed over a user's mouth, the body having an inner volume that surrounds the user's mouth when the body is placed over the user's mouth; a sensor located on the body; and a dielectrophoretic filter located on the body, the dielectrophoretic filter configured to allow air to pass between the inner volume of the body and the outside environment when the body is placed over the user's mouth, wherein the dielectrophoretic filter is adjustable based on feedback from the sensor; said face mask activated when breathing through first and second electrodes of the dielectrophoretic filter; said dielectrophoretic filter suspending microbes of infectious disease from air passed between said outside environment and said inner volume of the body; said face mask operational with one volt and said face mask wirelessly connected to an external computer or personal electronic device.

9. The face mask of claim 8, wherein the dielectrophoretic filter includes the first electrode and the second electrode, and wherein at least one of the first electrode and the second electrode is adjustable based on the feedback from the sensor.

10. The face mask of claim 9, wherein the at least one of the first and second electrodes is adjusted by at least one of: (i) compression or stretching; (ii) heating or cooling; (iii) acoustics; (iv) electromagnetics (v) sonic, infrasonic and/or ultrasonic waves; (vi) electrowetting; and (vii) electrocapillary effect.

11. The face mask of claim 8, wherein the sensor includes an environmental pollution sensor configured to monitor air quality of an outside environment.

12. The face mask of claim 8, wherein the sensor includes a respiratory sensor located on the mask and said respiratory sensor is configured to monitor air quality within the inner volume to monitor the user's respiration.

13. A method of using a face mask comprising:

placing a body over a user's mouth so that an inner volume of the body surrounds the user's mouth, the body including a dielectrophoretic filter sized and shaped to allow air to pass between the inner volume of the body and the outside environment when the body is placed over the user's mouth;

causing the dielectrophoretic filter to create an electric field gradient as air passes between the inner volume of the body and the outside environment which suspends microbes of infectious disease from air passed between said outside environment and said inner volume of the body;

breathing air from the outside environment through the dielectrophoretic filter;

activating said mask when breathing through first and second electrodes of said dielectrophoretic filter; said face mask operational with one volt;

connecting said face mask wirelessly to an external computer or personal electronic device; and monitoring the user's respiration.

14. The method of claim 13, wherein causing the dielectrophoretic filter to create an electric field gradient is caused by breathing into the inner volume.

15. The method of claim 13, wherein causing the dielectrophoretic filter to create an electric field gradient includes activating an electronic trigger.

16. The method of claim 13, which includes monitoring air quality of the outside environment.

17. The method of claim 16, which includes adjusting one of the first and second electrodes of the dielectrophoretic filter based on the air quality of the outside environment.

18. The method of claim 13, which includes adjusting one of the first and second electrodes of the dielectrophoretic filter based on the user's respiration.

* * * * *